US005676263A

United States Patent [19]

Chang

[11] Patent Number: 5,676,263

[45] Date of Patent: Oct. 14, 1997

[54] MODULAR RACK

[76] Inventor: Hsi-Te Chang, No. 76, Chen-Hsing Rd., Ke-Tso Tsun, Yuan-Chang Hsiang, Yun-Lin Hsien, Taiwan

[21] Appl. No.: 667,613

[22] Filed: Jun. 21, 1996

[51] Int. Cl.[6] ..... A47F 5/00

[52] U.S. Cl. ..... 211/187; 211/181; 211/188; 108/144; 108/180

[58] Field of Search ..... 211/187, 188, 211/181, 205; 248/159; 108/144, 106, 180

[56] References Cited

U.S. PATENT DOCUMENTS

| | | | |
|---|---|---|---|
| 3,523,508 | 8/1970 | Maslow | 211/181 X |
| 3,757,705 | 9/1973 | Maslow | 108/144 |
| 4,595,107 | 6/1986 | Welsch | 211/181 X |
| 5,127,342 | 7/1992 | Taylor | 211/187 X |
| 5,595,312 | 1/1997 | Davdashti | 211/188 |

FOREIGN PATENT DOCUMENTS

| | | | |
|---|---|---|---|
| 355827 | 7/1922 | Germany | 211/188 |

*Primary Examiner*—Robert W. Gibson, Jr.
*Attorney, Agent, or Firm*—Christie, Parker & Hale, LLP

[57] ABSTRACT

A modular rack includes at least three spaced post units, a plurality of tubular sleeves and a plurality of trays. Each of the post units includes a hollow upper post, a cylindrical connector, and a hollow lower post. Each of the upper and lower posts has an outer surface formed with a plurality of annular peripheral grooves. The connector threadedly interconnects the upper and lower post. The connector further includes a radially protruding flange portion between the upper and lower posts. The flange portion has an outer diameter smaller than that of the upper and lower posts and cooperates with the upper and lower posts to form an annular retaining groove. The tubular sleeves are sleeved on the post units. Each of the tubular sleeves is formed with a radial inward protrusion which extends into a selected one of the peripheral and retaining grooves in the upper and lower posts. Each of the trays has a peripheral portion provided with at least three spaced positioning tubes and has a length which is at least equal to the length of each of the upper and lower posts. Each of the positioning tubes is sleeved tightly on one of the tubular sleeves.

2 Claims, 6 Drawing Sheets

MODULAR RACK

BACKGROUND OF THE INVENTION

1. Field of the Invention

The present invention relates to a modular rack, more particularly to a modular rack which requires less packaging material, which has a relatively small volume after packaging, and which is more convenient to transport.

2. Description of the Related Art

In a rack having a plurality of trays, in addition to the stability requirement, the distance between the trays or the height of each of the trays on the rack is preferably adjustable to provide suitable spacing for various goods having different sizes and heights in order to achieve efficient use of the space provided by the rack. A conventional rack has a metal frame which includes several metal posts. Each of the metal posts is formed with a plurality of positioning screw holes for screw rods, on which trays are supported, to pass through, thereby fixing the trays. In order to adjust the height and position of the trays supported on the screw rods, the screw rods should be loosened and removed from the original screw holes and then threaded into another set of screw holes. Therefore, it is inconvenient to adjust the height of a tray on the conventional rack. A simple modular rack which offers added convenience when adjusting the positions and the heights of the trays thereon has been suggested to overcome the foregoing deficiencies.

FIGS. 1 and 2 are an exploded perspective view and a partly sectional view of the conventional modular rack. The modular rack 1 includes four spaced posts 11, a plurality of parallel trays 12 hanging among the four posts 11 and a plurality of sets of four tubular sleeves 13. The post 11 is an integrally formed elongated rod which is provided with a plurality of equally spaced annular peripheral grooves 111. Each tubular sleeve 13 consists of two curved pieces 131 which are engaged fittingly to form an axial through hole 132 having a configuration which conforms to the shape of the post 11. The tubular sleeve 13 is formed with a radial inward protrusion 133 within the axial through hole 132. The radial inward protrusion 133 extends into the annular grooves 111 in the post 11. The thickness of each tubular sleeve 13 gradually increases from top to bottom, thereby forming a diverging outer wall 134 which has a narrow top end 135 and a wide bottom end 136. The tray 12 includes a tray body 121 which has four positioning tubes 14 provided at the four corners of the tray body 121. Each positioning tube 14 has an inner diameter larger than the narrow top end 135 but smaller than the wide bottom end 136 of the tubular sleeves 13.

To assemble the conventional rack 1, a set of four tubular sleeves 13 are respectively sleeved onto the four posts 11 at an equal height. The radial inward protrusions 133 of the four tubular sleeves 13 extend into the annular grooves 111 of equal height in the four posts 11, respectively. The four positioning tubes 14, which are provided at the four corners of the tray 12, are sleeved onto the four posts 11 respectively such that the four tubular sleeves 13 which have been fixed to the four posts 11 extend thereinto. Since the inner diameter of the positioning tubes 14 is smaller than the outer diameter of the wide bottom end 136 of the tubular sleeves 13, the positioning tubes 14 are restricted by the wide bottom end 136 of the tubular sleeves 13. Therefore, the positioning tubes 14 are tightly fitted and stably positioned on the tubular sleeves 13. Similarly, when another tray 12 is to be fixed to the posts 11, the positioning tubes 14 of the tray 12 are sleeved on another set of tubular sleeves 13 which have been fixed to the four posts 11 at another height. To adjust the height of the tray 12, the tray 12 should be moved upwardly and the tubular sleeves 13 should be removed so as to be fixed in another desired position on the posts 11.

Although it is convenient to adjust the height of the trays on the modular rack 1, the use of the integrally formed posts 11 results in several drawbacks. In order to provide sufficient space, the posts 11 are usually much longer than the trays 12. However, the integrally formed posts 11 cannot be placed within the trays 12 which are much shorter than the posts 11. Thus, the posts 11 and the trays 12 have to be packed individually, thereby resulting in waste of packaging material, and in inconvenience during transport. Even if the posts 11 and the trays 12 can be packed together, the package is unavoidably unsatisfactory. The unsatisfactory package is also difficult and inconvenient to transport, store, and carry by the consumer.

SUMMARY OF THE INVENTION

Therefore, the main object of this invention is to provide a modular rack for placing objects thereon. The modular rack of this invention requires less packaging material and is more convenient to transport. Accordingly, the modular rack of the present invention includes at least three spaced post units, a plurality of tubular sleeves and a plurality of trays. Each of the post units includes a hollow upper post, a cylindrical connector, and a hollow lower post. Each of the upper and lower posts has an outer surface formed with a plurality of annular peripheral grooves. The upper post has an internally threaded bottom end. The lower post has an internally threaded top end. The connector has an externally threaded upper portion extending into and engaging threadedly the internally threaded bottom end of the upper post. The connector further has an externally threaded lower portion extending into and engaging threadedly the internally threaded top end of the lower post. The connector further includes a radially protruding flange portion between the upper and lower portions. The flange portion has an outer diameter smaller than that of the upper and lower posts. After the upper and lower posts have threadedly engaged the connector, the connector cooperates with the upper and lower posts to form an annular retaining groove. The tubular sleeves are sleeved on the post units. Each of the tubular sleeves is formed with a radial inward protrusion which extends into a selected one of the peripheral and retaining grooves in the upper and lower posts. Each of the trays has a peripheral portion provided with at least three spaced positioning tubes and has a length which is at least equal to the length of each of the upper and lower posts. Each of the positioning tubes is sleeved on one of the tubular sleeves. Since the length of each of the upper and lower posts is not longer than the length of the trays, the posts can be packed together with the trays, thereby resulting in a more economical package which is more convenient to transport.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
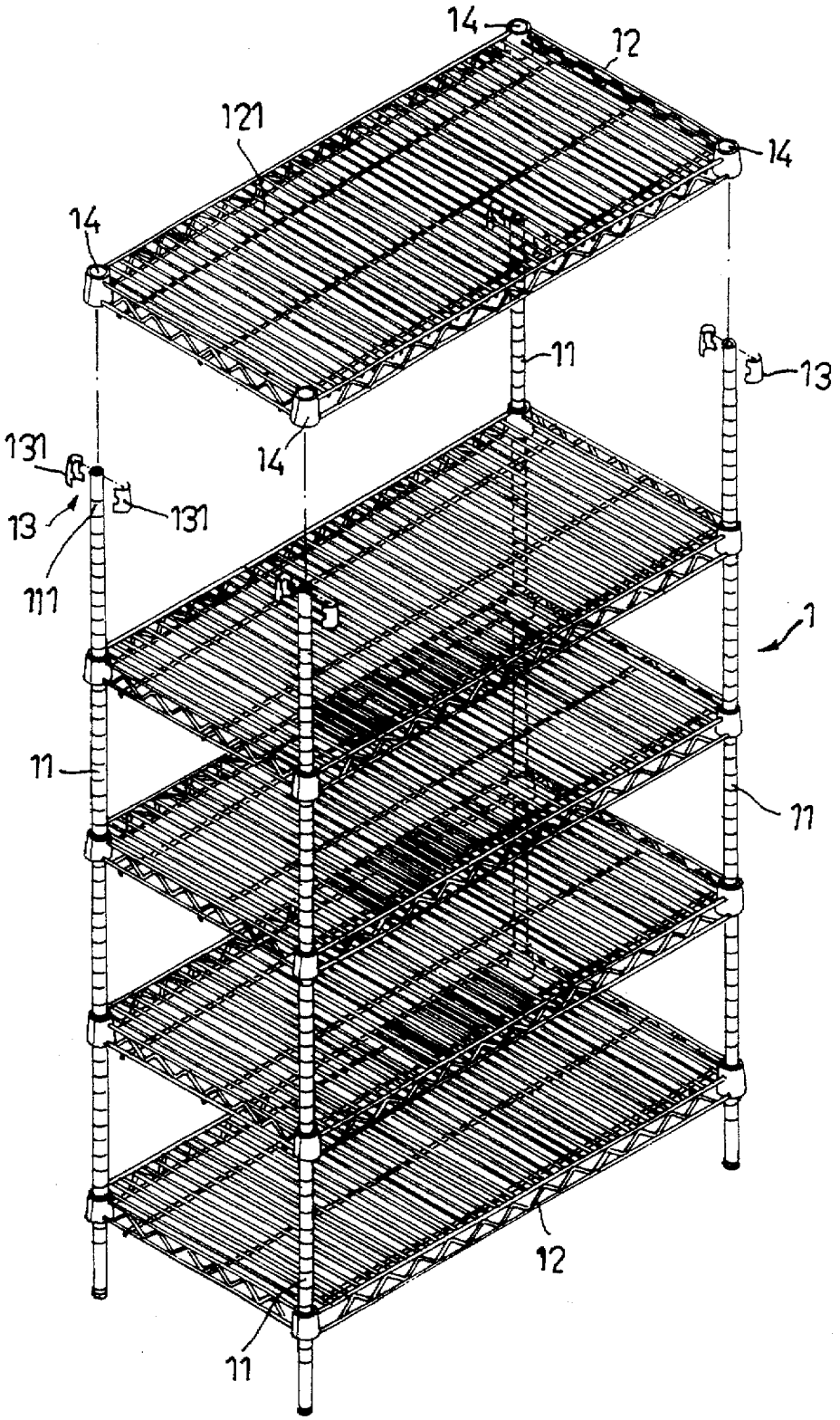
FIG 1 PRIOR ART
FIG. 1 is an exploded perspective view of a conventional modular rack.
Figure 2:
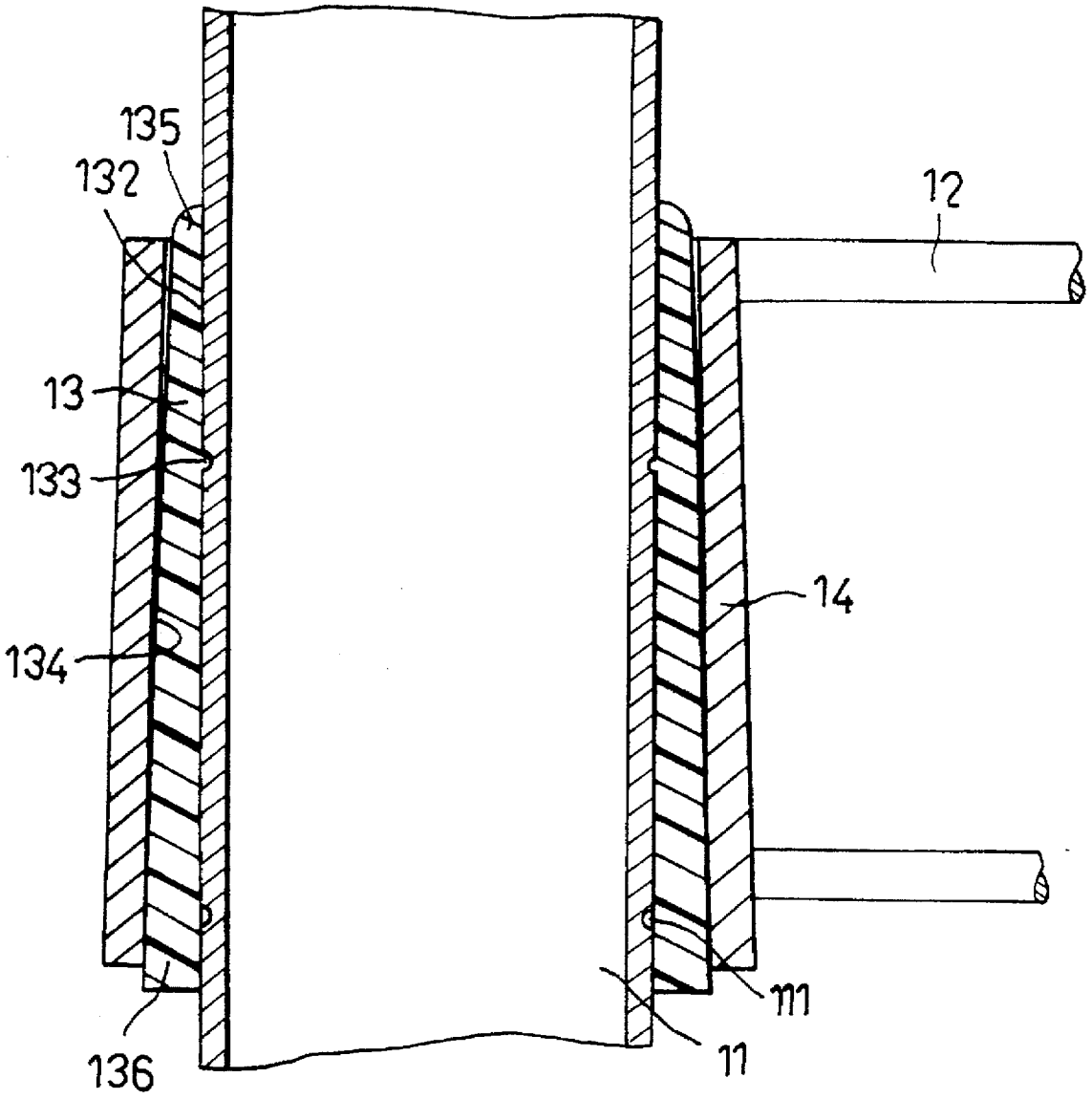
FIG. 2 PRIOR ART
FIG. 2 is a partly sectional view of the conventional modular rack of FIG. 1.
Figure 3:
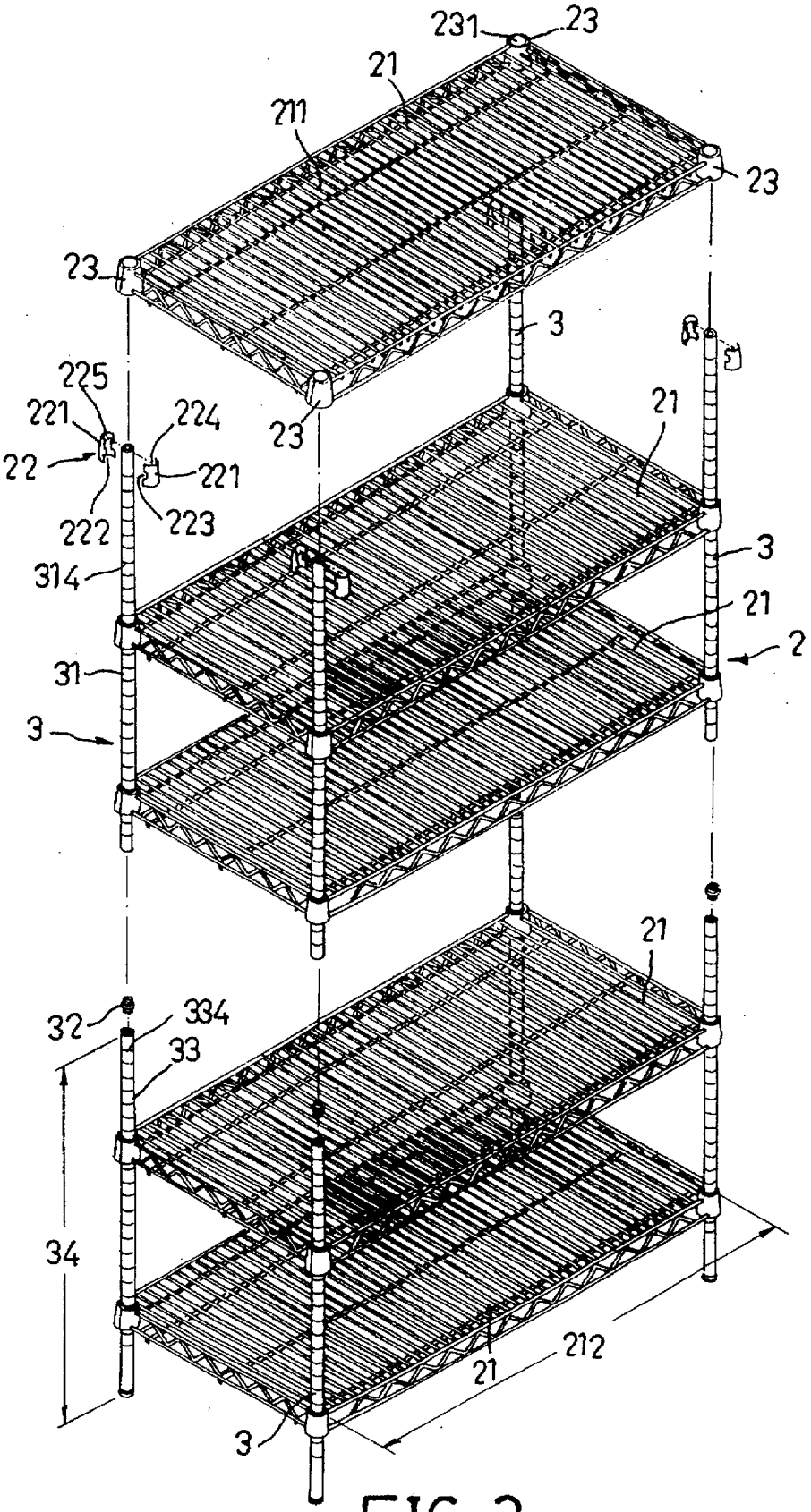
FIG. 3 is an exploded perspective view of a preferred embodiment of the present invention.
Figure 4:
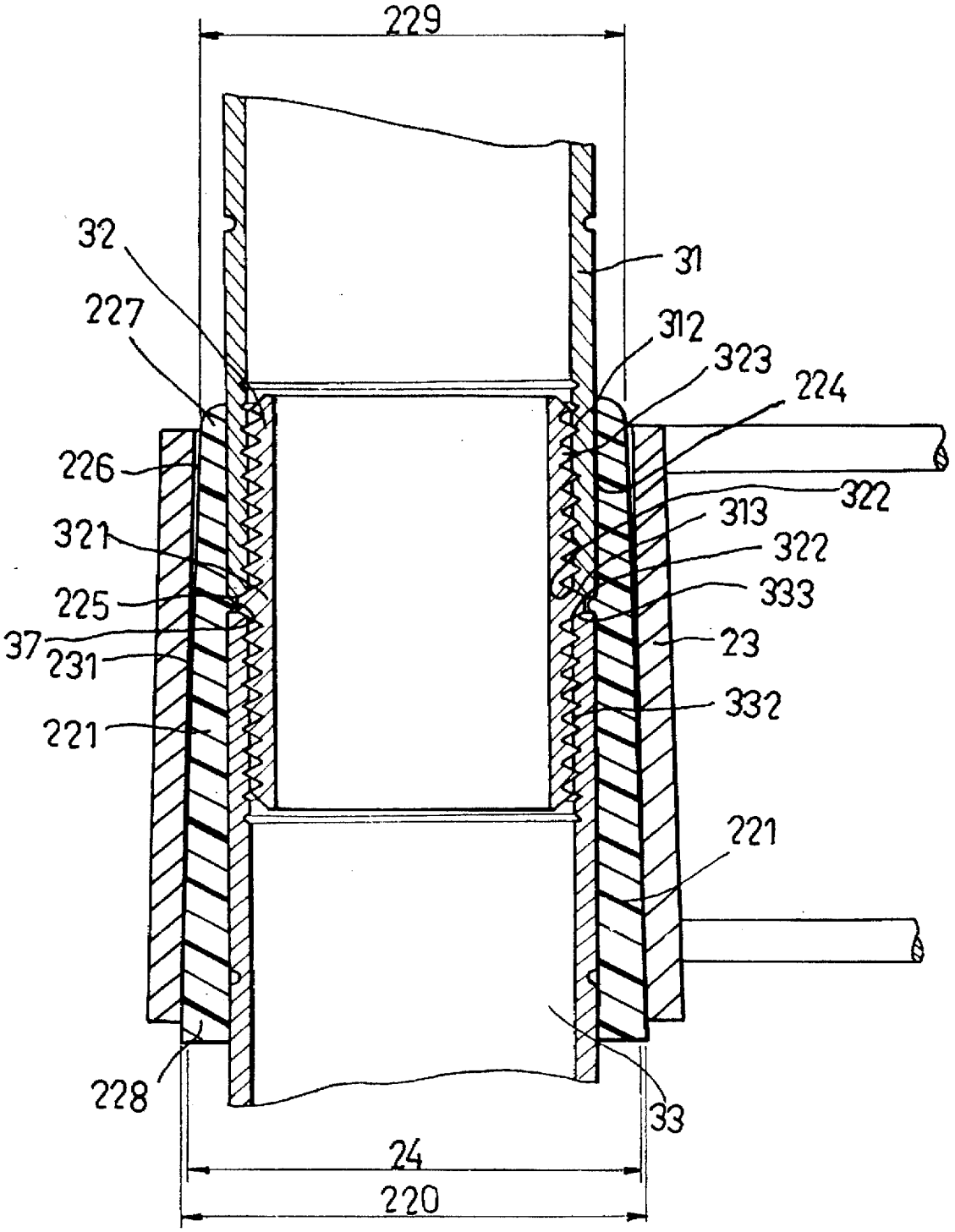
FIG. 4 is a partly sectional view of the preferred embodiment.

Referring to FIGS. 3 and 4, the preferred embodiment of a modular rack 2 of this invention is shown to include four post units 3, a plurality of trays 21, and a plurality of tubular sleeves 22. The number of tubular sleeves 22 is four times the number of the trays 21. Each set of four tubular sleeves 22 are sleeved respectively on the four post units 3 at an equal height. Each of the tubular sleeves 22 consists of two curved pieces 221 which are engaged fittingly through the engagement between a protruding portion 222 on one of the curved pieces 221 and an indented portion 223 on the other one of the curved pieces 221. An axial through hole 224 having a configuration which conforms to the shape of any of the post units 3 is formed within each of the tubular sleeves 22. Each of the tubular sleeves 22 is formed with a radial inward protrusion 225 which extends into annular peripheral grooves 314, 334 in the post units 3. The thickness of each of the tubular sleeves 22 gradually increases from top to bottom, thereby forming a diverging outer wall 226 which includes a narrow top end 227 and a wide bottom end 228. Each of the trays 21 includes a tray body 211 which is provided with four positioning tubes 23 at the four corners of the tray body 211. Each of the positioning tubes 23 is formed with a positioning through hole 231 for one of the post units 3 to pass through. The diameter 24 of the positioning through hole 231 is larger than the outer diameter 229 of the narrow top end 227 but smaller than the outer diameter 220 of the wide bottom end 228 of the tubular sleeve 22.

Figure 5:
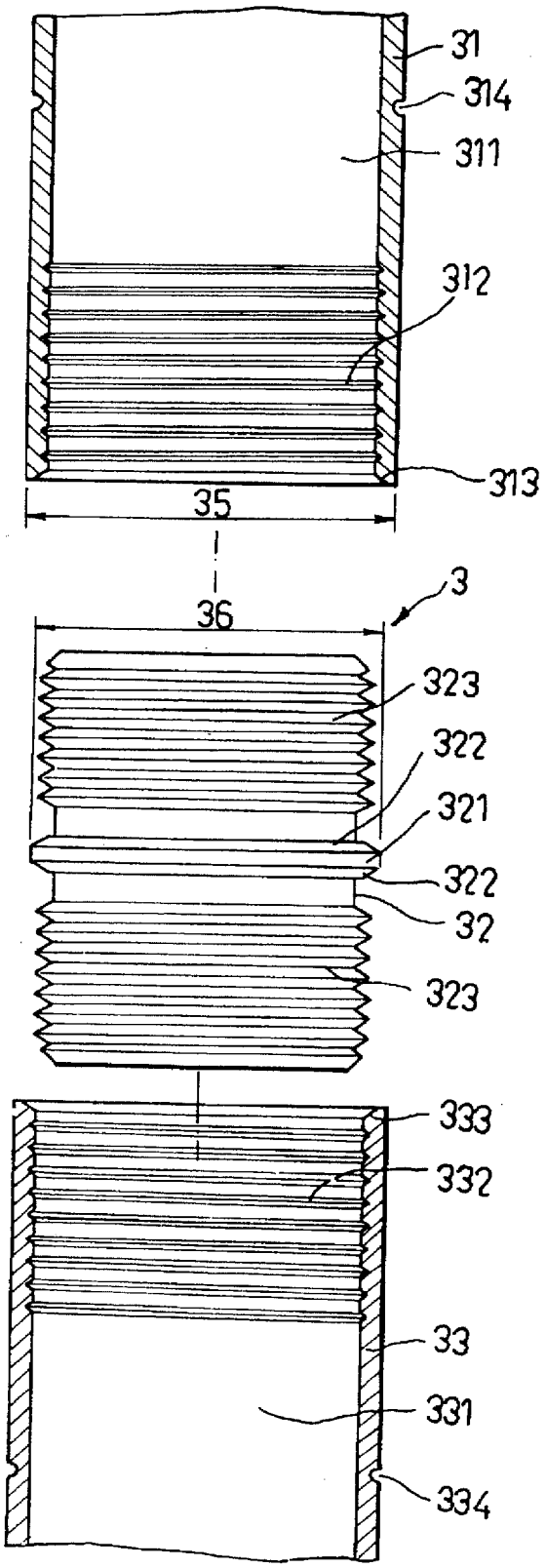
FIG. 5 is an exploded, partly sectional, schematic view of the post unit of the preferred embodiment.

Referring to FIGS. 3 and 5, each of the post units 3 of the preferred embodiment includes a hollow upper post 31, a cylindrical connector 32 and a hollow lower post 33. Each of the upper posts 31 is tubular in shape and is formed with an axial passage 311 therein. Each of the upper posts 31 has an internally threaded bottom end 312 formed with an inclined edge 313. Each of the upper posts 31 is formed with a plurality of equally spaced annular peripheral grooves 314. The length 34 of each of the upper posts 31 is shorter than or equal to the length 212 of each of the trays 212. Each of the lower posts 33 has a substantially identical structure and length as compared to each of the upper posts 31 and is also formed with an axial passage 331. The lower post 33 has an internally threaded top end 332 formed with an inclined edge 333 and is also formed with a plurality of annular peripheral grooves 334. Each of the peripheral grooves 314, 334 is capable of retaining the radial inward protrusion 225 of each of the tubular sleeves 22. The connector 32 interconnects the upper and lower posts 31, 33 and has a radially protruding flange portion 321 between the upper and lower posts 31, 33. The outer diameter 36 of the radially protruding flange portion 321 is smaller than the outer diameter 35 of the upper and lower posts 31, 33. The flange portion 321 has inclined top and bottom sides 322. The connector 32 further includes externally threaded upper and lower portions 323 for engaging threadedly the internally threaded bottom end 312 of the upper post 31 and the internally threaded top end 332 of the lower post 33, respectively.

Referring again to FIGS. 4 and 5, during assembly of the modular rack 2, the components of the post units 3 should be connected axially at first. The internally threaded bottom end 312 of the upper post 31 and the internally threaded top end 332 of the lower post 33 threadedly engage the externally threaded upper and lower portions 323 of the connector 32, respectively. The inclined edge 313 at the bottom end of the upper post 31 and the inclined edge 333 at the top end of the lower post 33 abut against the inclined sides 322 of the radially protruding flange portion 321 of the connector 32, respectively. Thus, the radially protruding flange portion 321 of the connector 32 is between the upper and lower posts 31, 33. Since the outer diameter 36 of the flange portion 321 is smaller than the outer diameter 35 of each of the upper and lower posts 31, 33, the flange portion 321 cooperates with the upper and lower posts 31, 33 to form an annular retaining groove 37 having a width equal to the width of the peripheral grooves 314, 334 in the upper and lower posts 31, 33, thereby completing the assembly of the post units 3.

As shown in FIGS. 3 and 4, in order to complete the modular rack 2, the tubular sleeves 22 should be sleeved on the four post units 3 at an equal height. This is achieved by virtue of engagement between the radial inward protrusion 225 of each of the tubular sleeves 22 and a selected one of the peripheral and retaining grooves 314, 37 in the upper and lower posts 31, 33. The four positioning tubes 23 of each of the trays 22 are sleeved tightly on the four tubular sleeves 22 and are restricted by the wide bottom end 228 of the tubular sleeves 22. Similarly, when another tray 21 is to be fixed, the positioning tubes 23 of the other tray 21 is sleeved on another set of tubular sleeves 22 which have been fixed to the four post units 3 at another height. Application of downward pressure to the tray 21 results in secure positioning of the tray 21 on the tubular sleeves 22.

Figure 6:
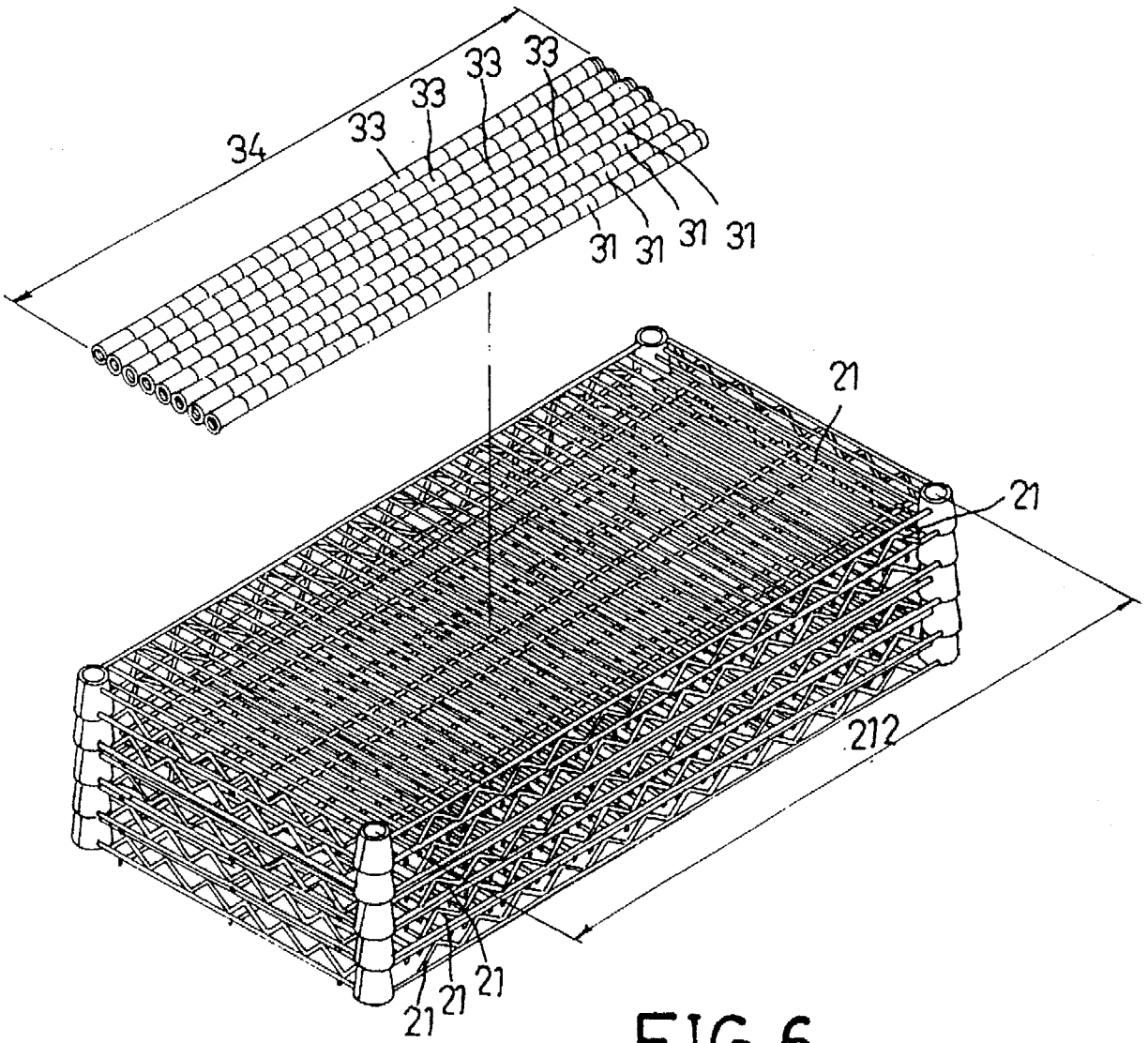
FIG. 6 is a schematic view of the preferred embodiment after the components thereof have been disassembled.

Referring to FIGS. 3 and 6, when the modular rack 2 of the present embodiment is to be disassembled for packaging, storage or transport purposes, an uppermost one of the trays 21 should be lifted. The four tubular sleeves 22 are then stripped from the four post units 3. In this way, each of the trays 21 can be removed sequentially from the post units 3. After all of the trays 21 have been removed from the post units 3, the upper and lower posts 31, 33 are detached from the connector 32. Since the length of each of the upper and lower posts 31, 33 is not longer than that of the trays 21, the upper and lower posts 31, 33 can be placed on the stacked trays 21 for packing with the trays 21.

The modular rack 2 of the preferred embodiment is shown to include four post units 3. The present invention, however, should not be limited to the preferred embodiment since other known rack configurations are also included in the scope of the present inventions. For the purpose of the present invention, at least three post units 3 are required in order to provide stability to the modular rack 2.

The post unit 3 of the preferred embodiment is shown to include an upper post 31 and a lower post 33. The post unit 3 of the present invention, however, can be expanded to include three posts. In this case, two connectors 32 are required for connecting the three posts.

With the use of the modular rack of the present invention, the post units can be packed with other components. This results in added convenience during packaging, storage and transport of the modular rack.

With this invention thus explained, it is apparent that numerous modifications and variations can be made without departing from the scope and spirit of this invention. It is therefore intended that this invention be limited only as indicated in the appended claims.

I claim:

1. A modular rack for placing objects thereon, comprising:

at least three spaced post units, each of which includes a hollow upper post, a cylindrical connector, and a hollow lower post, each of said upper and lower posts having an outer surface formed with a plurality of annular peripheral grooves, said upper post having an internally threaded bottom end, said lower post having an internally threaded top end, said connector having an externally threaded upper portion which extends into and which engages threadedly said internally threaded bottom end of said upper post, said connector further having an externally threaded lower portion which extends into and which engages threadedly said internally threaded top end of said lower post, and a radially protruding flange portion between said upper and lower portions, said flange portion having an outer diameter smaller than that of said upper and lower posts and cooperating with said upper and lower posts to form an annular retaining groove;

a plurality of tubular sleeves sleeved on said post units, each of said tubular sleeves being formed with a radially inward protrusion which extends into a selected one of said peripheral and retaining grooves in said upper and lower posts; and a plurality of trays, each of which has a peripheral portion provided with at least three spaced positioning tubes, each of which is sleeved tightly on one of said tubular sleeves, each of said trays having a length which is at least equal to length of each of said upper and lower posts.

2. The modular rack according to claim 1, wherein said radially protruding flange portion of said connector has inclined top and bottom sides, each of said upper and lower posts having a distal edge that abuts against a respective one of said top and bottom sides.

* * * * *